United States Patent [19]

Freeze

[11] 4,214,331

[45] Jul. 29, 1980

[54] METHOD FOR PROCESSING SOCKS

[75] Inventor: Baxter P. Freeze, Randleman, N.C.

[73] Assignee: Commonwealth Hosiery Mills, Inc., Randleman, N.C.

[21] Appl. No.: 44,587

[22] Filed: Jun. 1, 1979

[51] Int. Cl.[3] ..... D06B 5/24

[52] U.S. Cl. ..... 8/150; 8/DIG. 21; 34/21; 34/42

[58] Field of Search ..... 8/150, DIG. 21; 68/20, 68/235 R; 34/21, 42, 103, 104; 223/76, 112

[56] References Cited

U.S. PATENT DOCUMENTS

| | | | |
|---|---|---|---|
| 2,333,160 | 11/1943 | Dunn | 8/150 X |
| 2,678,868 | 5/1954 | Drum et al. | 8/150 |
| 2,985,502 | 5/1961 | Kronsbein et al. | 8/150 |

*Primary Examiner*—Philip R. Coe

[57] ABSTRACT

A method for processing anklet socks knit with at least some thermoplastic stretchable yarns and having cuff portions in which the socks are subjected to a dye bath and excess fluid is extracted from the socks leaving them damp to the touch, and thereafter placing a first sock on a sock form while damp and enveloping the first sock with the second damp sock forming a pair of socks after which the paired socks may have their cuff portions folded over simultaneously before being subjected to elevated temperatures to dry the socks and remove wrinkles with the socks having substantial bulk and stretch when dried.

3 Claims, 10 Drawing Figures

METHOD FOR PROCESSING SOCKS

BACKGROUND AND OBJECTIVES OF THE INVENTION

Substantial manufacturing costs are incurred in the processing of anklet socks after they have been knit due to numerous manual operations including inspecting, boarding, pairing, cuff folding, among other operations which are time consuming. Also, displaying anklet socks on a counter frequently result in separation of the socks and mismatching.

Generally, when socks that are knitted with thermoplastic stretchable yarns are dyed and scoured, they are subjected to elevated temperatures for drying whether in a relaxed condition or on a boarding form which may set the stitches and wrinkles due to the thermoplasticity of the yarns. Substantial stretch and bulk may be removed and wrinkles set in the socks resulting in decreased counter appeal. Furthermore, in production, it is extremely tedious for operators to achieve continuously the precise fold down for a cuff portion of an anklet making pairing somewhat more difficult without further readjustment of the turndown cuff length.

It is, therefore, an objective of this invention to provide a process whereby anklet socks may be handled more economically and expeditiously while retaining substantial bulk and stretch.

Another objective of this invention is to provide a process in which anklet socks knit with at least some thermoplastic stretchable yarn and having cuff portions may be handled with fewer manual operations to produce a more attractive final paired sock package.

Other objectives and many of the attendant advantages of this process will become more readily apparent to those skilled in the hosiery finishing art from the following detailed description taken in conjunction with the accompanying drawing and from the appended claims in which equivalents are contemplated.

BRIEF DESCRIPTION OF THE PROCESS OF THE INVENTION

Figure 1:
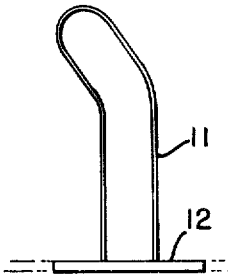
FIG. 1 is a side elevational view of an anklet form.

Referring to the drawing and particularly to FIGS. 1 through 5 there is illustrated a sequence of steps that are employed in the process for handling anklet socks 10 which are knit from at least some thermoplastic stretchable yarns generally processed on false twist texturing machines to impart stretched characteristics to the yarn which stretch characteristics are then manifested in the stretchable nature of the knit fabric in the anklet. After the anklets 10 are knit and the toe closures formed, they are placed in a sack and subjected to a dye bath and scouring to dye the socks and to remove any oils from the yarns. It will be understood that bleaching the yarns is emcompassed within the term "dyeing". The dyed and scoured socks are then extracted to remove excess fluid leaving the socks damp to the touch but without excess moisture being retained in the socks.

Figure 2:
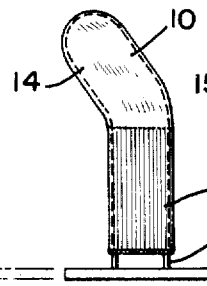
FIG. 2 is a view similar to FIG. 1 having a first anklet mounted on the form.
Figure 3:
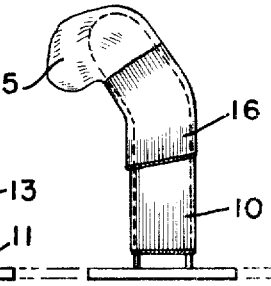
FIG. 3 is a view similar to FIG. 2 having a first sock on the form and placing a second sock thereover.
Figure 4:
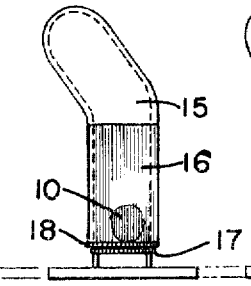
FIG. 4 is a view similar to FIG. 3 with the second sock substantially enveloping the first sock positioned on the sock form.
Figure 5:
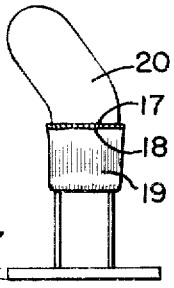
FIG. 5 is a view similar to FIG. 4 of the paired anklet socks folded back in the cuff portion.
Figure 6:
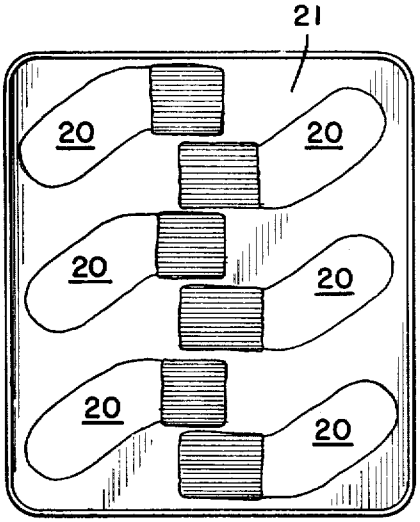
FIG. 6 is a top plan view of a plurality of socks positioned on a tray.
Figure 7:
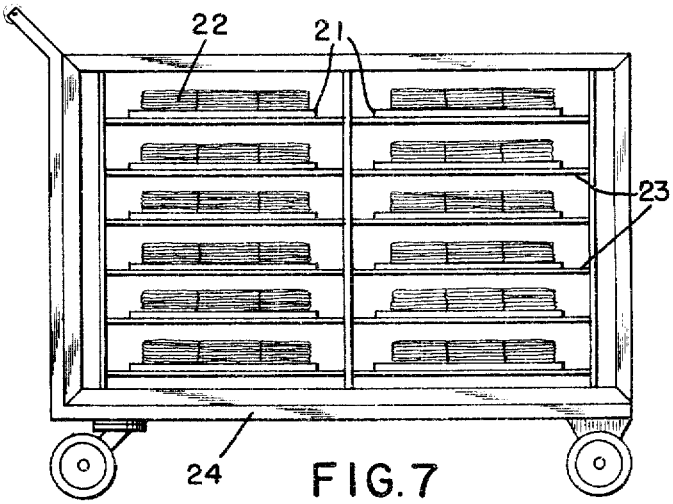
FIG. 7 is a side view of a wheeled cart having a plurality of sock supporting trays with socks supported thereon.
Figure 9:
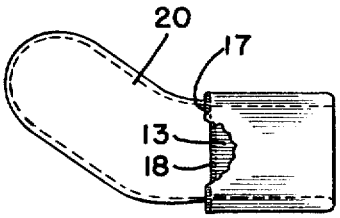
FIG. 9 is a slightly enlarged side view of a pair of anklet socks with cuffs turned down and a portion of the cuff of one sock removed.
Figure 8:
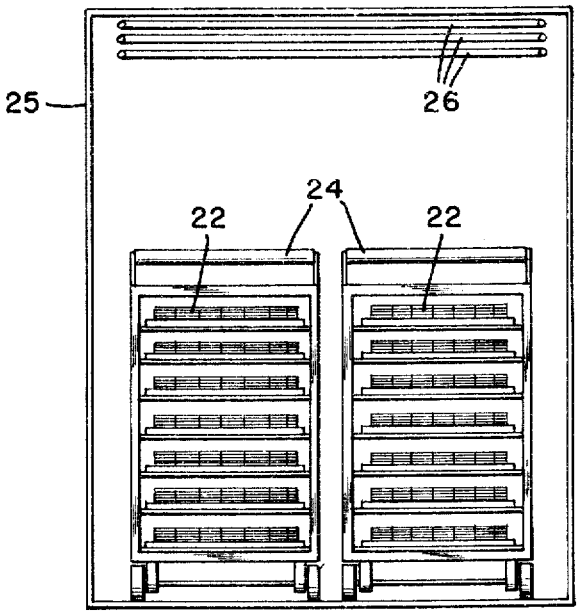
FIG. 8 is a partial transverse view of a chamber for subjecting the socks supported on the wheeled carts to elevated temperatures for drying.
Figure 10:
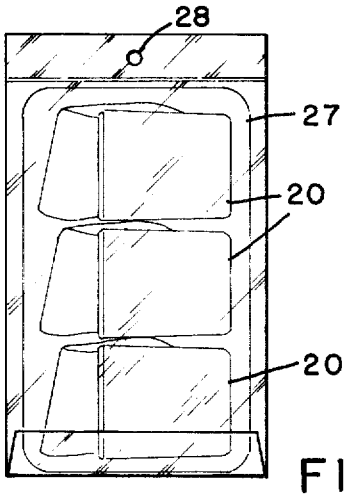
FIG. 10 is a plan view of a package containing three pairs of socks within an envelope.

The socks, while damp, are then conveyed to an operator who will be stationed adjacent to a wire sock-receiving form 11 that is mounted on the base 12 which may be positioned on a stationary table or other support at the appropriate level convenient for the operator. A first sock 10 having a cuff portion 13 and a foot portion 14 is positioned in extended condition on the wire sock frame 11, as shown in FIG. 2. A second sock 15 having a cuff portion 16 is placed, while damp, over the damp first sock 10 in the manner as shown in FIG. 3 until the second sock 15 substantially envelopes the first sock 10, with both socks 10 and 15 remaining damp to the touch as shown in FIG. 4. It is desirable that the selvage or end 17 of the first sock 10 extend slightly lower than the selvage or terminal end 18 of the sock 15 in the unturned condition of the pair of anklets as shown in FIG. 4. The cuff portions 13 and 16 of the paired socks shown in FIG. 4 are turned simultaneously upwardly so that both cuffs are folded back forming the folded cuff section 19 as shown in FIG. 5 with the edge 17 slightly overlapping the edge 18 of the cuff 16 on the second sock 15, as shown in FIG. 5. The paired and cuffed socks 20, while still damp, will be removed and placed on a substantially flat sock-receiving tray 21 with the paired and cuffed socks 20 being positioned on the tray 21 in stacks that are aligned for optimum exposure to elevated temperatures with the cuff anklets 20 still remaining in a damp condition.

A number of the trays 21 with stacks 22 of the cuff anklets 20 positioned thereon being placed on shelves 23 that are supported and vertically spaced from each other on the wheeled cart 24 with the socks still remaining in a dampened condition. The wheeled cart 24 with the stacked and cuffed socks 22 thereon are wheeled into a chamber 25 which may be sealed closed. Chamber 25 is provided with a series of pipes or coils 26 that are supported within chamber 25 and pass therethrough live steam to elevate the temperature within the chamber to approximately 170° F. or higher subjecting the stacked cuffed socks 22 which are damp when they enter chamber 25 on the wheeled cart 24 to a dry heat at elevated temperatures to volatize any moisture that remains within the damp socks 20. The cycle for retaining the damp socks within chamber 25 at an elevated temperature of 170° F. with dry heat is approximately 1 hour. However, with increased temperature, the cycle may be decreased but this will depend upon the extent of moisture retained in the socks 20.

It will be readily appreciated that electrically energized heaters or gas fired heaters may be utilized in place of the steam coils to achieve the requisite elevated temperature within chamber 25 to dry the socks therein.

The condition of the paired and cuffed socks 20 upon removal from the chamber 25 upon completion of the drying cycle will not only be in a dry condition but any superficial wrinkles that may have been imparted to the socks during previous processing will be removed and some partial shrinking may occur due to the latent stretch characteristics of the thermoplastic yarns to yield a sock that is generally more stretchable than one that has been heat set in a conventional boarding procedure.

The paired and cuffed socks which have been further folded may then be packaged individually or in multiples in a clear polyethylene envelope 27 which may be provided with an opening 28 for hanging display. The protective envelope will prevent soiling of the cuffed anklets when placed on a counter and will also eliminate separation of the paired socks.

It has been found desirable to maintain the spacing between the edges 17 and 18 of the individual socks as set fourth above, however, the distance is a matter of choice and the edges may coincide or one or the other protrude slightly provided it is not objectionable.

I claim:

1. A method for processing anklet socks knit with at least some thermoplastic stretchable yarns and having cuff portions comprising the steps of; placing a plurality of anklet socks in a dye bath, subjecting the anklet socks to said dye bath for a predetermined time interval, extracting excess fluid from said socks leaving said socks damp to the touch, placing a first sock on a sock form while damp, placing a second sock over said first sock while damp to envelope said first sock to form a pair of socks on said form, removing said pair of socks from said form, and heating said pair of socks to dry them whereby wrinkles are removed and the paired socks have substantial bulk and stretch.

2. A method for processing anklet socks knit with at least some thermoplastic stretchable yarns and having cuff portions as claimed in claim 1, positioning the sock edge of the second sock a relatively short distance from the sock edge of the first sock upon placing said second sock over said first sock, and folding over the cuff portion of said first and second sock simultaneously whereby the cuff portion edges of the paired socks substantially coincide.

3. A method for processing anklet socks knit with at least some thermoplastic stretchable yarns and having cuff portions as claimed in claim 1, and subjecting said paired socks in a drying room at an elevated temperature of approximately 170° F. under substantially dry heat for approximately one hour.

* * * * *